United States Patent [19]

Nozaki et al.

[11] Patent Number: 4,849,598

[45] Date of Patent: Jul. 18, 1989

[54] METHOD OF AND APPARATUS FOR BAKING COATING LAYER UTILIZING ELECTRICAL INDUCTION AND EDDY CURRENTS

[75] Inventors: Hiroyoshi Nozaki; Uhee Kikuchi, both of Sayama, Japan

[73] Assignee: Honda Giken Kogyo Kabushiki Kaisha, Tokyo, Japan

[21] Appl. No.: 175,403

[22] Filed: Mar. 30, 1988

[30] Foreign Application Priority Data

| | | | |
|---|---|---|---|
| Mar. 30, 1987 | [JP] | Japan | 62-79445 |
| Mar. 30, 1987 | [JP] | Japan | 62-79446 |
| Jan. 29, 1988 | [JP] | Japan | 63-19132 |
| Feb. 18, 1988 | [JP] | Japan | 63-36580 |

[51] Int. Cl.[4] ..... H05B 6/02; F26B 21/10; B05D 3/02

[52] U.S. Cl. ..... 219/10.41; 219/10.75; 219/10.491; 34/1; 34/4; 34/243 C; 118/642; 118/643; 427/45.1; 427/372.2

[58] Field of Search ..... 219/10.41, 10.43, 10.57, 219/10.67, 10.71, 10.75, 10.49 R; 34/1, 4, 43, 243 C; 118/58, 620, 621, 623, 640, 641, 643, 642, 644; 427/45.1, 372.2

[56] References Cited

U.S. PATENT DOCUMENTS

| | | | |
|---|---|---|---|
| 3,561,131 | 9/1968 | Swartz | 34/1 |
| 3,576,664 | 9/1968 | Swartz | 34/1 |
| 3,759,670 | 9/1973 | Rummel | 219/10.43 X |
| 4,321,444 | 3/1982 | Davies | 219/10.41 |
| 4,416,068 | 11/1983 | Nilsson et al. | 34/4 |
| 4,420,667 | 12/1983 | Lewis | 219/10.41 |
| 4,453,067 | 6/1984 | Karklys et al. | 219/10.49 R |
| 4,456,804 | 6/1984 | Lasky et al. | 219/10.43 |
| 4,563,558 | 1/1986 | Rhemer et al. | 219/10.49 R |

FOREIGN PATENT DOCUMENTS

| | | | |
|---|---|---|---|
| 0202869 | 5/1986 | European Pat. Off. . | |
| 705294 | 6/1951 | United Kingdom | 34/2 |
| 1335952 | 4/1972 | United Kingdom . | |
| 1470207 | 9/1974 | United Kingdom . | |

*Primary Examiner*—A. D. Pellinen
*Assistant Examiner*—David Osborn
*Attorney, Agent, or Firm*—Birch, Stewart, Kolasch & Birch

[57] ABSTRACT

A coating layer such as a paint coating, a sealer, or the like on an electrically conductive workpiece such as an automotive body is baked or dried by holding an induction coil or induction coils closely to the workpiece, supplying an electric current to the induction coil or coils to induce eddy currents in the workpiece to heat the workpiece with the eddy current, and applying a gas such as air to the surface of the coating layer to bake or dry the same.

19 Claims, 10 Drawing Sheets

METHOD OF AND APPARATUS FOR BAKING COATING LAYER UTILIZING ELECTRICAL INDUCTION AND EDDY CURRENTS

BACKGROUND OF THE INVENTION

The present invention relates to a method of and an apparatus for baking a coating layer, and more particularly to a method of and an apparatus for baking a coating layer such as a paint coating, a sealer, or the like applied to a workpiece by supplying electric currents to induction coils to generate eddy currents for efficiently and smoothly baking and drying the coating layer.

In order to protect workpieces such as automotive bodies from rain, wind, and sunlight, it is widely practiced to bake paint coatings applied to the workpieces thereby to provide durable weather-resistant coating layers. According to the baking process, the paint coating applied to a workpiece is heated to assist in volatilizing a solvent such as a thinner for promoting the reaction of a binder mixed in the paint coating, thus hardening the paint coat layer. Generally, the paint coating on the workpiece is heated by placing the coated workpiece in a drying furnace and applying hot air to the workpiece to dry the paint coating (see Japanese Laid-Open Patent Publication No. 55-119466).

In the conventional drying process, however, hot air is applied to the surface of the paint coating on the workpiece within the drying furnace, and hence the paint coating layer is hardened as a film progressively from its surface toward the surface of the workpiece. If the paint coat has surface irregularities, therefore, it will be hardened with the irregularities remaining on its surface. Accordingly, the paint coating surface is not smooth, and no sightly paint coating is produced. To prevent this drawback, it is necessary to provide a setting step prior to drying the paint coating for turning an applied paint coating layer into a stable paint film and smoothing the surface of the paint coating layer.

As shown in FIG. 1 of the accompanying drawings, a paint coating line usually has a coating booth 2 for effecting a paint coating step, a setting room 4 for carrying out the setting step, and a drying furnace 6. In the drying furnace 6, a paint coating or the like applied to a workpiece is baked and dried by the step of heating the paint coating and the step of keeping the paint coating heated.

Then, the workpiece is taken out of the drying furnace and cooled. It can be seen from FIG. 1 that the paint coating step and the setting step are carried out at normal temperature.

With the setting room 4 provided, however, the length of the entire painting line is increased and hence workpieces will have to stay on the painting line for a considerable period of time. Therefore, a practical demand for the processing of workpieces effectively in a short time cannot be met.

The setting room 4 requires equipment for preventing a solvent which is volatilized in the setting step from being scattered and for discharging the volatilized solvent. As a consequence, the cost of manufacturing the entire painting line is increased.

The progressive hardening of the paint coat from its surface, as described above, is disadvantageous in that the hardened film tends to hamper volatilization of the solvent from the paint. Therefore, the paint coating cannot be dried in a short interval of time. Where the paint coat layer is hardened with the solvent remaining in the paint, small cavities or pinholes are developed in the coated paint layer. Such pinholes allow moisture to produce rust on the workpiece surface and make the coated surface unsightly.

The drying process of applying hot air against the coated surface causes a large heat loss and is therefore not efficient.

SUMMARY OF THE INVENTION

It is a general object of the present invention to provide a method of and an apparatus for baking a coating layer such as a paint coating, a sealer, or the like on an electrically conductive workpiece by supplying electric currents to induction coils to produce eddy currents in the workpiece and heat the workpiece, so that the coating layer can efficiently and smoothly be dried, the apparatus being small in size and manufactured at a reduced cost.

Another object of the present invention is to provide a method of baking a coating layer on an electrically conductive workpiece, comprising the steps of: holding an induction coil closely to the workpiece; supplying an electric current to the induction coil to induce eddy currents in the workpiece to heat the workpiece with the eddy current; and applying a gas to the surface of the coating layer to dry the same.

Still another object of the present invention is to provide a method of baking a coating layer on an electrically conductive workpiece, wherein the gas applied to the surface of the coating layer flows as laminar flows.

Yet another object of the present invention is to provide a method of baking a coating layer on an electrically conductive workpiece, wherein the magnitude of the electric current supplied to the induction coil is controlled to adjust the temperature to which the workpiece is heated.

Yet still another object of the present invention is to provide an apparatus for baking a coating layer on an electrically conductive workpiece, comprising: a plurality of coating drying mechanisms disposed to surround the workpiece; and a gas supply source, each of the coating drying mechanisms including a plurality of induction coils displaceable complementarily to the shape of the workpiece to a position spaced a predetermined distance from the workpiece, displacing means for displacing the induction coils, and applying means for applying a gas supplied from the gas supply source to the coating layer on the workpiece.

A further object of the present invention is to provide an apparatus for baking a coating layer on an electrically conductive workpiece, wherein the displacing means comprises a linear actuator movable toward and away from the workpiece.

A still further object of the present invention is to provide an apparatus for baking a coating layer on an electrically conductive workpiece, wherein the applying means comprises an air blower chamber coupled to the gas supply source and a tube communicating with the air blower chamber and expandable toward and contractable away from the coating layer on the workpiece.

A yet further object of the present invention is to provide an apparatus for baking a coating layer on an electrically conductive workpiece, wherein each of the coating drying mechanisms has a discharge port for discharging the gas applied to the coating layer on the workpiece.

A yet still further object of the present invention is to provide a method of baking a coating layer on a workpiece, comprising the steps of: heating the workpiece to produce convective flows in the coating layer; smoothing the surface of the coating layer with the convective flows; and drying the coating layer with the surface thereof being smoothed by the convective flows.

It is also an object of the present invention to provide a method of baking a coating layer, comprising the steps of: applying a coating layer to an electrically conductive workpiece; holding an induction coil closely to the workpiece; supplying an electric current to the induction coil to induce eddy currents in the workpiece to heat the workpiece with the eddy current; introducing a gas from outside of the induction coil toward the workpiece to cool the induction coil with the gas; and applying the gas heated by the induction coil to the surface of the coating layer to dry the same.

Another object of the present invention is to provide a method of baking a coating layer on a workpiece, wherein the temperature of the gas near the induction coil is detected, and then the amount of the gas to be introduced toward the workpiece is adjusted dependent on the detected temperature for thereby applying the gas heated to a desired temperature to the surface of the coating layer.

Still another object of the present invention is to provide an apparatus for baking a coating layer on an electrically conductive workpiece, comprising: a plurality of coating drying mechanisms disposed to surround the workpiece; and blower means, each of the coating drying mechanisms comprising a plurality of casings having one end open toward the workpiece and movable toward and away from the workpiece, and induction coils disposed respectively in the casings, the arrangement being such that a gas supplied from the blower means is applied through the induction coils in the casings to the surface of the coating layer.

Yet another object of the present invention is to provide an apparatus for baking a coating layer on an electrically conductive workpiece, wherein the induction coils are disposed in the casings near the open ends, the blower means having outlet ports opening at opposite ends of the casings for applying the gas through gaps of the induction coils to the surface of the coating layer.

Yet still another object of the present invention is to provide an apparatus for baking a coating layer on an electrically conductive workpiece further including drive sources coupled respectively to the casings for moving the casings toward and away from the workpiece, the blower means including tubes in the form of bellows connected to the casings.

A further object of the present invention is to provide an apparatus for baking a coating layer on an electrically conductive workpiece, wherein the blower means has a gas supply source, further including a flow control valve disposed between the gas supply source and the casings, and a temperature sensor disposed in one of the casings near the induction coil, and means for adjusting the amount of the gas to be supplied to the casings based on the temperature detected by the temperature sensor.

A still further object of the present invention is to provide a method of baking a coating layer, comprising the steps of: applying a coating layer to a workpiece; thereafter bringing the workpiece into an electrically conductive heating housing; supplying an electric current to an induction coil disposed outside the heating housing to induce eddy currents in the workpiece to heat the workpiece with the eddy current; and heating the workpiece with radiant heat produced from the heating housing to dry the coating layer on the workpiece.

A yet further object of the present invention is to provide a method of baking a coating layer, wherein a gas is applied to the surface of the coating layer on the workpiece while the workpiece is being heated by the heating housing which is heated by the induction coil.

A yet still further object of the present invention is to provide an apparatus for baking a coating layer on a workpiece, comprising: an electrically conductive heating housing defining a space for receiving the workpiece therein; an induction coil disposed outside the heating housing, the heating housing and the induction coil being spaced from each other; and an electric power supply coupled to the induction coil for energizing the induction coil to heat the heating housing by induction to cause the heating housing to produce heat for drying the coating layer on the workpiece.

Another object of the present invention is to provide an apparatus for baking a coating layer on a workpiece, wherein the heating housing and the induction coil are spaced from each other by a substantially equal distance at any position therebetween.

Still another object of the present invention is to provide an apparatus for baking a coating layer on a workpiece, further including gas supply means for applying a gas to the surface of the coating layer on the workpiece when the workpiece is heated.

Yet another object of the present invention is to provide an apparatus for baking a coating layer on a workpiece, wherein the workpiece has a first portion of a greater thickness and a second portion of a smaller thickness, the induction coil including a first group of turns adjacent to the first portion and a second group of turns adjacent to the second portion, the turns of the first group being spaced a smaller distance than the distance by which the turns of the second group are spaced.

Yet still another object of the present invention is to provide an apparatus for baking a coating layer on a workpiece, wherein the induction coil comprises a plurality of induction coils, and the electric power supply comprises a plurality of electric power supplies connected respectively to the induction coils.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
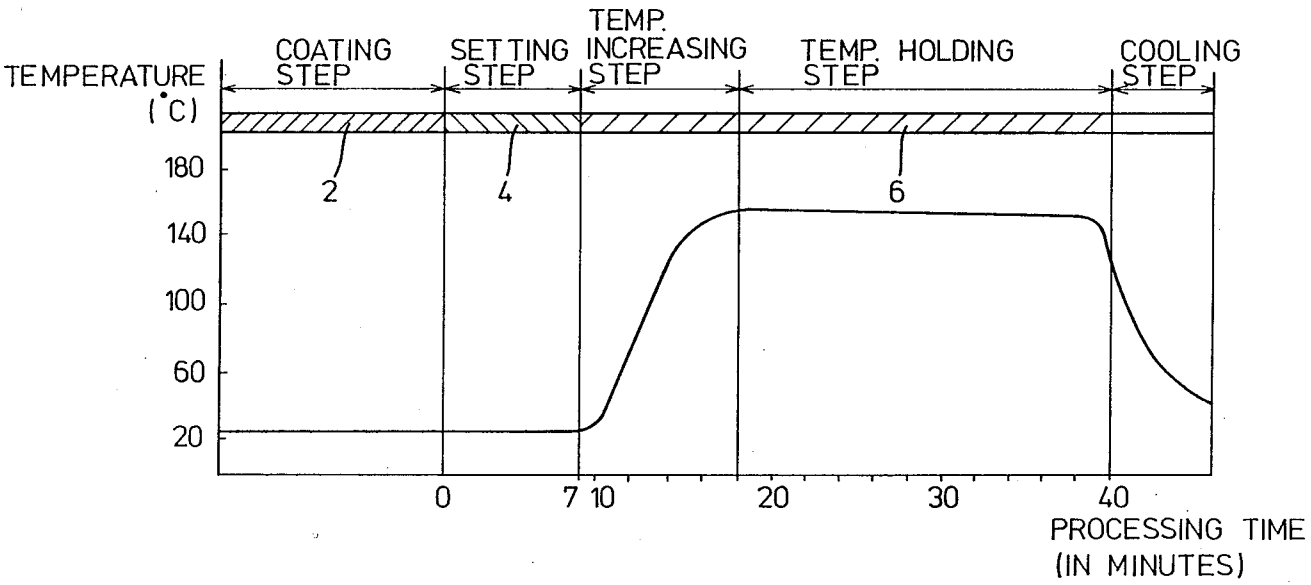
FIG. 1 is a diagram showing the relationship between the steps of a conventional paint coating line, processing time, and temperature.
Figure 2:
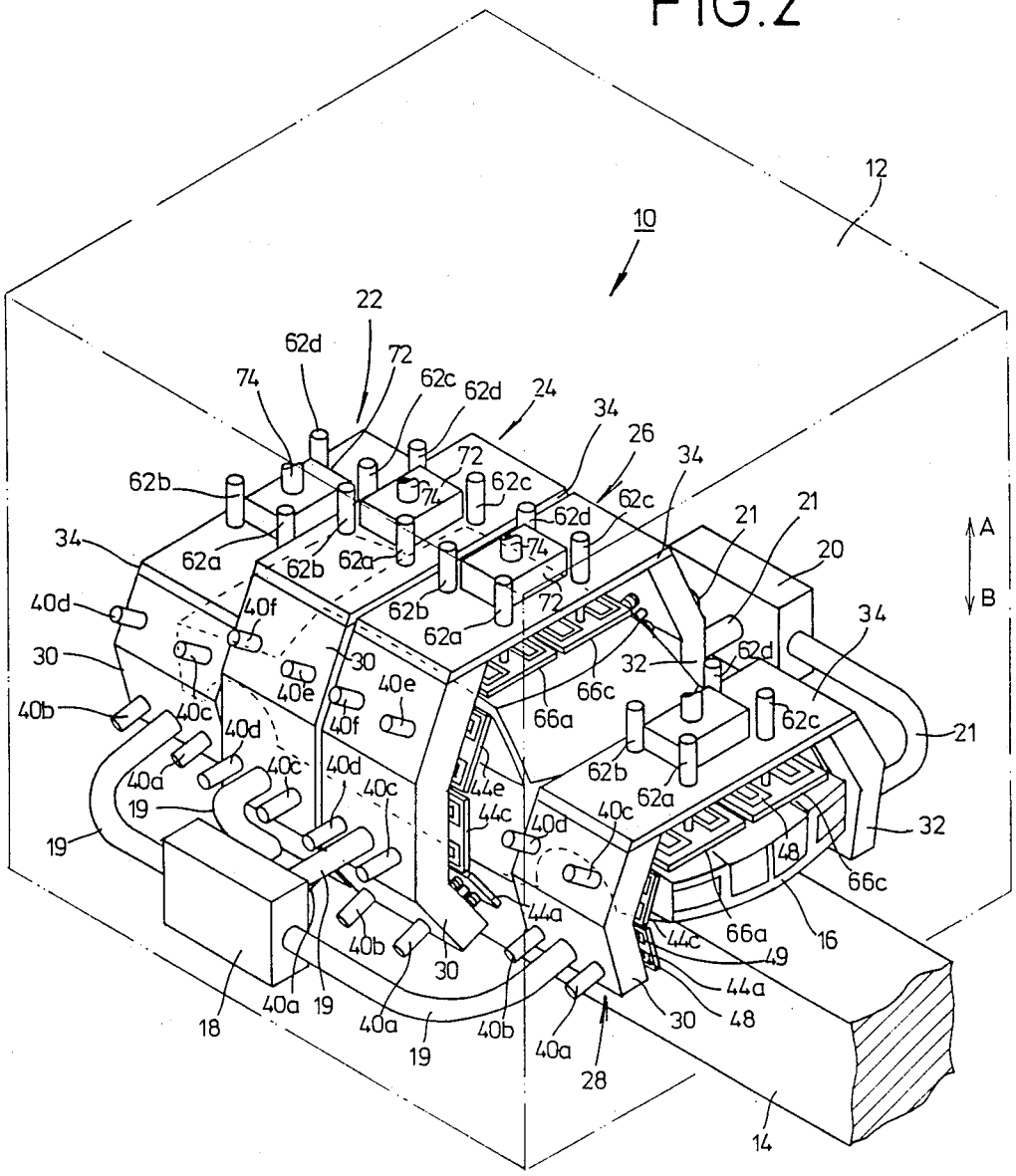
FIG. 2 is a perspective view of an apparatus for carrying out a method of baking a coating layer according to an embodiment of the present invention.
Figure 3:
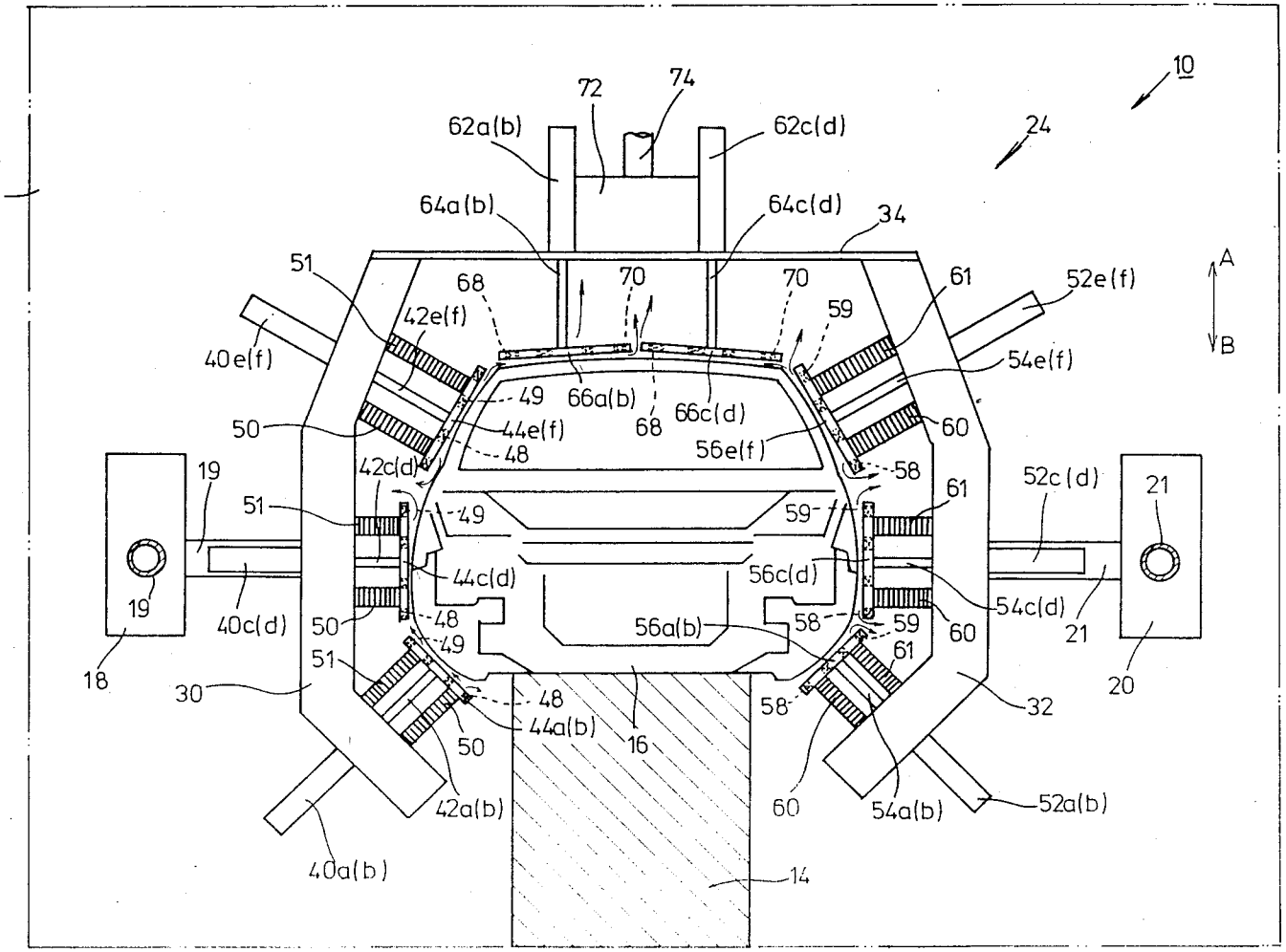
FIG. 3 is a front elevational view, partly in cross section, of the apparatus shown in FIG. 2.

FIGS. 2 and 3 show an apparatus, generally designated by the reference numeral 10, for carrying out a method of baking a coating layer such as a paint coating or a sealer in accordance with an embodiment of the present invention. In the illustrated embodiment, the apparatus 10 is designed to bake a paint coating on a workpiece such as an automotive body. The apparatus 10 is disposed in a drying furnace 12 for baking a paint coating layer applied to an automotive body 16 that is conveyed through the drying furnace 12 by a conveyor means 14.

The apparatus 10 includes a first air blower means 18 and a second air blower means 20, both for supplying a gas, e.g., air, to be applied to the automotive body 16, and a plurality of paint drying mechanisms 22, 24, 26, 28. The first and second air blower means 18, 20 are coupled to the paint drying mechanisms 22, 24, 26, 28 through a plurality of pipes 19, 21.

One of the paint drying mechanisms 22, 24, 26, 28, e.g., the paint drying mechanism 24, will be described below.

As shown in FIG. 3, the paint drying mechanism 24 includes a first air blower chamber 30 and a second air blower chamber 32 which are disposed one on each side of the automotive body 16 to be conveyed, and a plate 36 supported transversely on the first and second air blower chambers 30, 32. The plate 36 is displaceable selectively in the directions of the arrows A, B by means of a drive source (not shown). The first and second air blower chambers 30, 32 are displaceable toward and away from each other by means of a drive source (not illustrated). The first air blower chamber 30 communicates with the first air blower means 18 through the pipe 19, whereas the second air blower chamber 32 communicates with the second air blower means 20 through the pipe 21.

A plurality of cylinders **40*a*, 40*b*, 40*d*, 40*e*, 40*f* are mounted on an outer side of the first air blower chamber 30 and have respective piston rods 42*a* through 42*f* extending through holes (not shown) defined in the first air blower chamber 30 toward the automotive body 16. The piston rods 42*a* through 42*f* have distal ends on which respective coil holder plates 44*a* through 44*d* are supported. Therefore, the coil holder plates 44*a* through 44*f* can be moved toward and away from the automotive body 16 by the piston rods 42*a* through 42*f* when the cylinders 40*a* through 40*f*** are operated.

Figure 4:
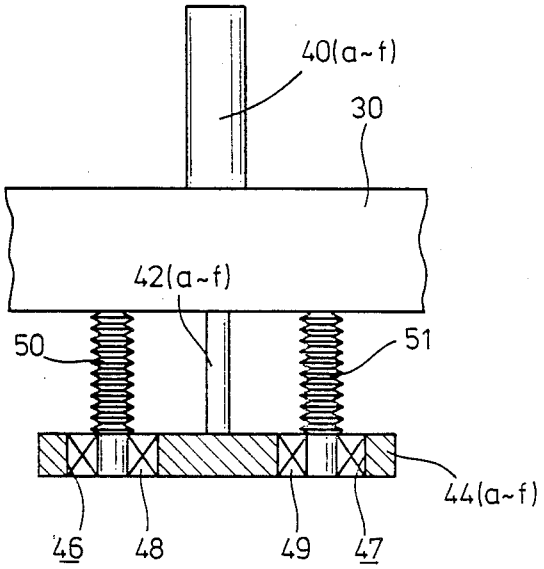
FIG. 4 is a fragmentary view, partly in cross section, of a portion of the apparatus illustrated in FIGS. 2 and 3.

As shown in FIG. 4, each of the coil holder plates **44*a* through 44*f* has a pair of holes 46, 47 defined therein and spaced in opposite directions away from the position where the coil holder plate engages one of the piston rods 42*a* through 42*f*. Hollow induction coils 48, 49 are fitted respectively in the holes 46, 47, and distal ends of tubes 50, 51 communicating with the first air blower chamber 30 are fitted respectively in the hollow induction coils 48, 49. The tubes 50, 51 are in the form of bellows that can be expanded and contracted in response to displacement of the coil holder plates 44*a* through 44*f* upon operation of the cylinders 40*a* through 40*f***.

Similarly, a plurality of cylinders **52*a* through 52*f* are mounted on the second air blower chamber 32, and have respective piston rods 54*a* through 54*f* supporting coil holder plates 56*a* through 56*f*, respectively, on their distal ends. Hollow induction coils 58, 59 are fitted in each of the coil holder plates 56*a* through 56*f*, and bellows tubes 60, 61 communicating with the second air blower chamber 32 have distal ends fitted respectively in the induction coils 58, 59**.

Cylinders **62*a* through 62*d* are mounted on the plate 34 supported on the first and second air blower chambers 30, 32, and have piston rods 64*a* through 64*d*, respectively, extending through holes (not shown) defined in the plate 34 toward the automotive body 16. The piston rods 64*a* through 64*d* support on their distal ends respective coil holder plates 66through 66*d* in each of which hollow induction coils 68, 70** are fitted.

An air discharge chamber 72 is mounted substantially centrally on the plate 34. An air discharge pipe 74 vented to atmosphere is connected to the air discharge chamber 72.

The paint drying mechanism 24 is basically constructed as described above. The other paint drying mechanisms 22, 26, 28 are substantially identical in construction to the paint drying mechanism 24. Therefore, those parts of the paint drying mechanisms 22, 26, 28 which are identical to those of the paint drying mechanism 24 are denoted by identical reference characters, and will not be described in detail. The number of the coil holder plates and the number of the induction coils on the paint drying mechanisms 22, 24, 26, 28 may be varied dependent on the surface area of a workpiece which is to be coated with paint.

Operation and advantages of the apparatus 10 for carrying out a method of baking a coating layer will now be described below.

The automotive body 16 to which a paint coating is applied is conveyed into the drying furnace 12 by the conveyor means 14. At this time, the plates 34 of the paint drying mechanisms 22, 24, 26, 28 of the apparatus 10 in the drying furnace 12 have been displaced in the direction of the arrow A. The first and second air blower chambers 30, 32 of each of the paint drying mechanisms 22, 24, 26, 28 have been displaced away from each other.

Then, the first and second air blower chambers 30, 32 are displaced toward each other, and thereafter the plates 34 are displaced in the direction of the arrow B. The cylinders **40*a* through 52*a* through 52*f*, and the cylinders 62*a* through 62*d* are actuated to bring the induction coils 48, 49, 58, 59, 68, 70 closer to the automotive body 16**.

More specifically, in the paint drying mechanism 24, the cylinders **40*a* through 40*f* on the first air blower chamber 30 are operated to displace the piston rods 42*a* through 42*f* for moving the induction coils 48, 49 on the coil holder plates 44*a* through 44*f* coupled to the piston rods 42*a* through 42*f* toward one lateral side of the automotive body 16. Likewise, the cylinders 52***a* through 52*f* on the second air blower chamber 32 are operated to move the coil holder plates 56*a* through 56*f* and hence the induction coils 58, 59 supported thereon toward the other lateral side of the automotive body 16. The cylinders 62*a* through 62*d* are actuated to lower the induction coils 68, 70 closer to an upper side of the automotive body 16. During this time, the tubes 50, 51, 60, 61 in the form of bellows are axially expanded as the induction coils 48, 49, 58, 59 are displaced toward the automotive body 16. Accordingly, the tubes 50, 51, 60, 61 do not obstruct the displacement of the induction coils 48, 49, 58, 59. The induction coils 48, 49, 58, 59, 68, 70 of the other paint drying mechanisms 22, 26, 28 are also displaced in the same manner as those of the paint drying mechanism 24.

Now, high-frequency electric currents are supplied to the induction coils 48, 49, 58, 59, 68, 70. The supplied currents induce eddy currents in the automotive body 16 positioned closely to the induction coils 48, 49, 58, 59, 68, 70. The eddy currents thus induced heat the automotive body 16 thereby producing convective flows in the paint coating applied to the automotive body 16. Specifically, the paint present in the paint coating near the automotive body 16 is heated to flow toward the outer surface of the paint coating, and the heated paint near the outer surface of the paint coating flows toward the automotive body 16.

The convective flows of the paint in the paint coating on the automotive body 16 make the paint coating surface smooth when the paint coating is dried. Therefore, the surface of the paint coating can be smoothed without any setting step carried out. As a result, the painting line coupled to the drying furnace 12 does not require any setting room, and hence is reduced in length and can be manufactured at a lower cost. Inasmuch as no setting step is included, the time consumed on the painting line is shortened. The temperature to which the automotive body 16 is heated can be adjusted by controlling the magnitude of the high-frequency currents supplied to the induction coils 48, 49, 58, 59, 68, 70.

With the illustrated embodiment, eddy currents are induced in the automotive body 16 by high-frequency currents supplied to the induction coils 48, 49, 58, 59, 68, 70 to heat the automotive body 16 for thereby drying or baking the paint coating on the automotive body 16. Therefore, any heat loss caused in drying the paint coating is smaller than that in the conventional drying process utilizing the application of hot air, and the paint coating on the automotive body 16 can efficiently be dried. Since the eddy currents heat the surface of the automotive body 16, the paint is dried progressively from the surface of the paint coating which is in contact with the surface of the automotive body 16. Accordingly, the paint is not progressively hardened from the outer surface of the paint coating, thus preventing the solvent from being trapped in the paint coating and also preventing pinholes from being developed in the paint coating.

Simultaneously with the drying of the paint coating as described above, the first and second air blower means 18, 20 are actuated to supply air into the first and second air blower chambers 30, 32 of the paint drying mechanisms 22, 24, 26, 28. The air supplied into the first air blower chamber 30 is applied to one lateral side of the automotive body 16 through the bellows tubes 50, 51 connected to the first air blower chamber 30. The air supplied into the second air blower chamber 32 is applied to the other lateral side of the automotive body 16 through the bellows tubes 60, 61. The air thus applied to the automotive body 16 flows as laminar flows along the coated surface of the automotive body 16 in the directions of the arrows (FIG. 3), and is finally discharged out from the air discharge chamber 72 above the automotive body 16 through the air discharge pipe 74.

The air flowing along the coated surface of the automotive body 16 is effective in accelerating volatilization of the solvent while at the same time preventing the solvent from being trapped in the paint coating when the automotive body 16 is heated, so as to produce a smooth surface of the paint coating.

A method of and an apparatus for baking a coating layer according to another embodiment of the present invention will hereinafter be described. Those components which are identical to those of the previous embodiment are designated by identical reference characters, and will not be described in detail.

Figure 5:
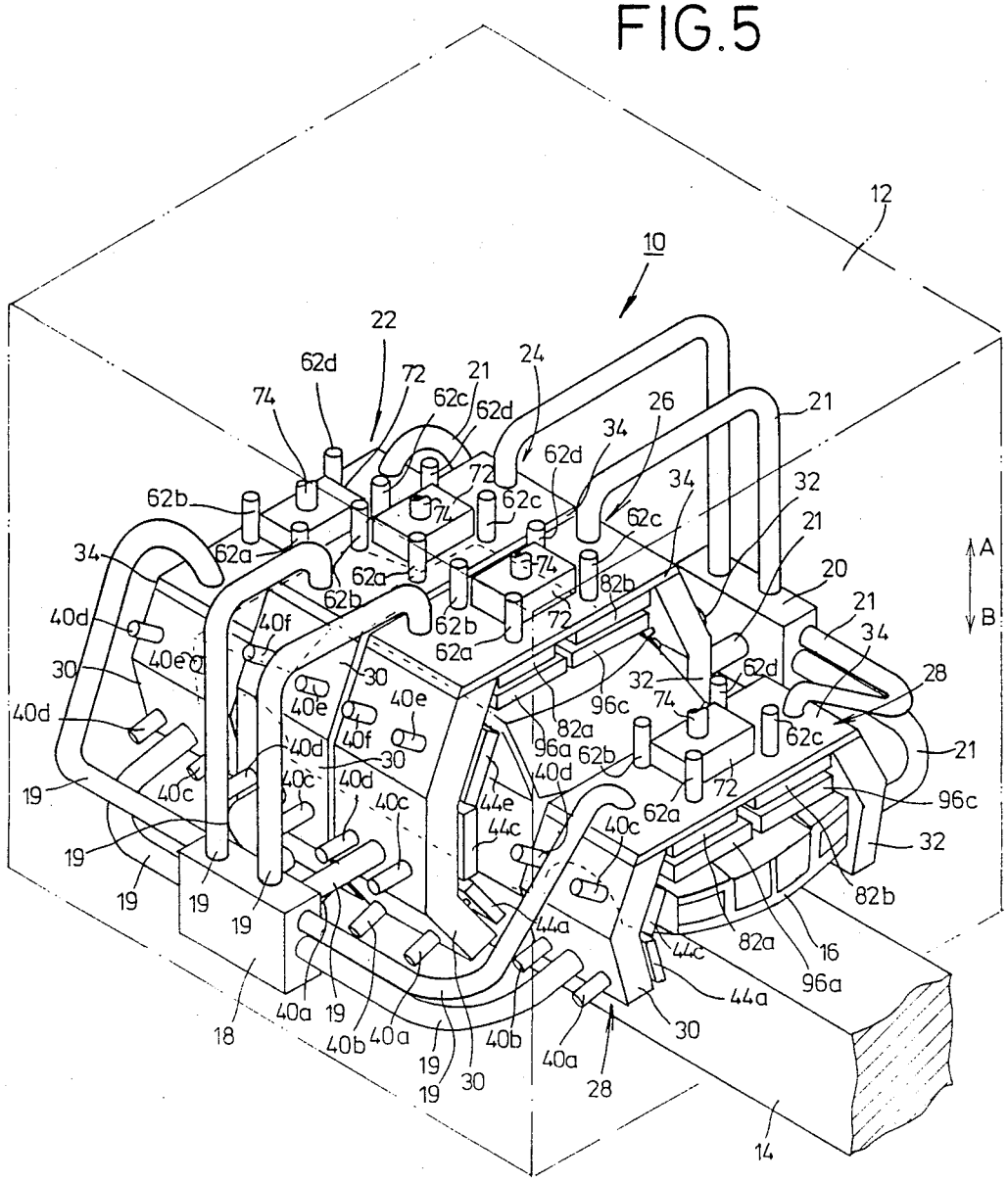
FIG. 5 is a perspective view of an apparatus for carrying out a method of baking a coating layer according to another embodiment of the present invention.
Figure 6:
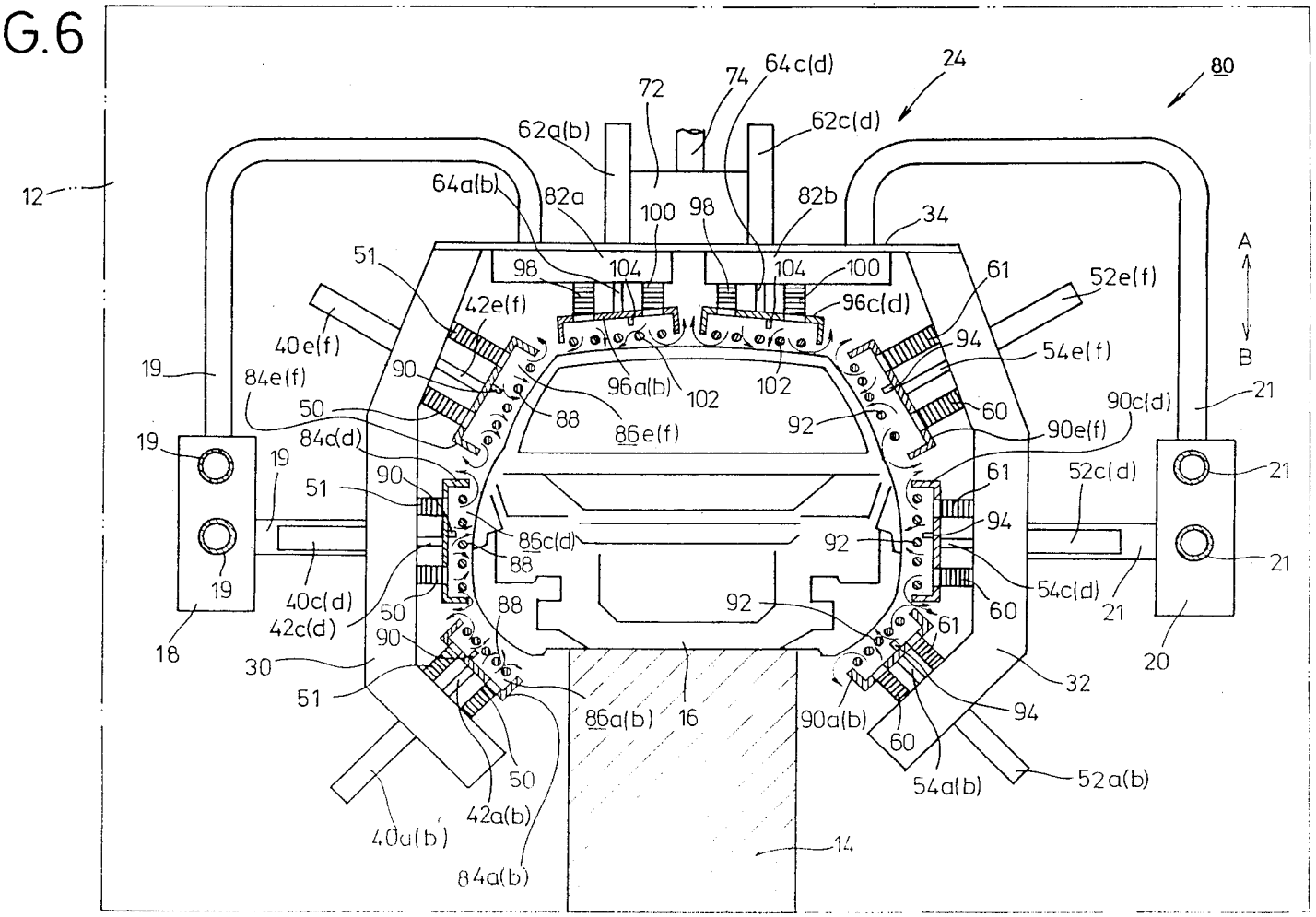
FIG. 6 is a front elevational view, partly in cross section, of the apparatus shown in FIG. 5.

As shown in FIGS. 5 and 6, an apparatus 80 additionally has third air blower chambers 82*a*, 82*b* 82*b* held by each of the plates 34 above the automotive body 16. The paint drying mechanism 24 will be described below by way of example. The first air blower chamber 30 and the third air blower chamber 82*a* communicate with the first air blower means 18 through pipes 19, whereas the second air blower chamber 32 and the other third air blower chamber 82*b* communicate with the second air blower means 20 through pipes 21.

Coil holder casings 84*a* through 84*f* are mounted on the distal ends of the piston rods 42*a* through 42*f* extending from the cylinders 40*a* through 40*f*. The coil holder casings 84*a* through 84*f* have chambers 86*a* through 86*f* defined respectively therein and vented to atmosphere through open ends of the casings 84*a* through 84*f*. The distal ends of the piston rods 42*a* through 42*f* are fixed to the other ends of the casings 84*a* through 84*f*The first air blower chamber 30 communicates with the chambers 86*a* through 86*f*via the bellows tubes 50, 51. Induction coils 88 are disposed in the chambers 86*a* through 86*f* near the open ends of the casings 84*a* through 84*f*, with temperature sensors 90 being located in the vicinity of the respective induction coils 88.

The piston rods 54*a* through 54*f* of the cylinders 52*a* through 52*f* extend through each of the second air blower chambers 32. Coil holder casings 90*a* through 90*f* are attached to the distal ends of the piston rods 54*a* through 54*f*, respectively. The ends of the bellows tubes 60, 61 are fitted in the casings 90*a* through 90*f* in communication with the second air blower chamber 32, with induction coils 92 being mounted in the casings 90*a* through 90*f*. Temperature sensors 94 are disposed respectively in the casings 90*a* through 90*f*.

Extending through the third air blower chambers 82*a*, 82*b*, are the piston rods 64*a* through 64*d* of the cylinders 62*a* through 62*d* which support on their distal ends coil holder casings 96*a* through 96*d*. Bellows tubes 98, 100 have distal ends fitted in each of the coil holder casings 96*a* through 96*d*, in which induction coils 102 and temperature sensors 104 are housed.

The paint drying mechanism 24 is basically of the above construction. The other paint drying mechanisms 22, 26, 28 are substantially the same as the paint drying mechanism 24. Therefore, those parts of the paint drying mechanisms 22, 26, 28 which are identical to those of the paint drying mechanism 24 are denoted by identical reference characters, and will not be described in detail.

Flow control systems for the first and second air blower means 18, 20 will be described with reference to FIG. 7.

The first air blower means 18 includes an air supply source 106 which is coupled to a plurality of flow control valve 108 through the pipes 19. The flow control valves 108 are coupled to ends of the tubes 50, 51, 98, 100, respectively, the other ends of which are held in communication with the casings 84*a* through 84*f* and the casings 96*a*, 96*b*. The temperature sensors 90, 104 disposed in the casings 84*a* through 84*f*, 96*a*, 96*b*supply temperature data to a controller 110, which controls the flow rate control valves 108 dependent on the supplied temperature data, respectively, for thereby adjusting the temperature of air applied from the casings 84*a* through 84*f*, 96*a*, 96*b*.

As a modification, a single flow control valve 108 may be connected to the air supply source 106, and the first and third air blower chambers 30, 82*a* may be connected to the single flow control valve 108 via a plurality of pipes 19. In this modification, the flow control valve is controlled on the basis of temperature data produced by the temperature sensor 90 in the casing 84*c* for simultaneously controlling the amounts of air to be supplied into the casings 84*a* through 84*f*, 96*a*, 96*b*.

The flow control system for the second air blower means 20 is identical to the flow control system, described above, for the first air blower means 18, and will not be described in detail.

Operation and advantages of the apparatus 80 for carrying out a method of baking a coating layer according to this embodiment will be described below.

The apparatus 80 operates in substantially the same manner as the apparatus 10 of the previous embodiment of the invention. The paint drying mechanisms 22, 24, 26, 28 are operated to move the induction coils 88, 92, 102 closer to the lateral and upper sides of the automotive body 16 in the drying furnace 12.

Then, the induction coils 88, 92, 102 are supplied with high-frequency electric currents which induce eddy currents in the automotive body 16 positioned closely to the induction coils 88, 92, 102. The automotive body 16 is heated by the eddy currents thereby to dry the paint coating on the automotive body 16 progressively from the surface of the paint coating which lies in contact with the automotive body 16.

The first and second air blower means 18, 20 are actuated to apply air to the induction coils 88, 92, 102 and the lateral and upper sides of the automotive body 16.

Figure 7:
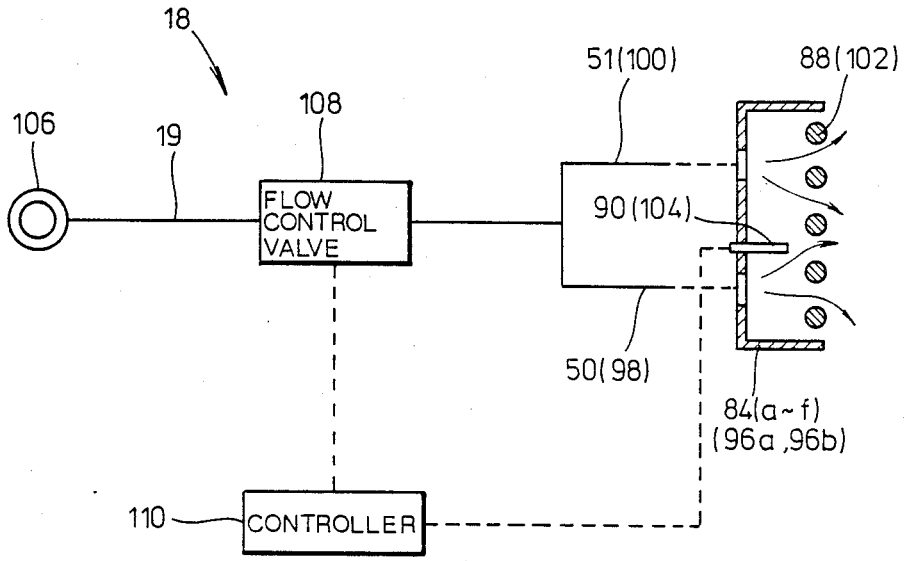
FIG. 7 is a schematic view, partly in block form, of a flow control system for an air blower arrangement in the apparatus shown in FIGS. 5 and 6.

More specifically, as shown in FIG. 7, compressed air is supplied from the air supply source 106 of the first air blower means 18 to the flow control valves 108. The pressure of compressed air is regulated by the flow control valves 108, after which the compressed air is introduced into the casings 84*a* through 84*f*, 96*a*, 96*b*. At this time, the induction coils 88, for example, disposed in the casings 84*a* through 84*f* closely to the open ends of the chambers 86*a* through 86*f* are heated to a considerable temperature by being supplied with high-frequency electric currents. Therefore, the air supplied into the chambers 86*a* through 86*f* cools the induction coils 88, and is heated thereby and applied to one lateral side of the automotive body 16.

The temperature sensors 90 disposed in the casings 84*a* through 84*f* detect the temperatures of air passing through the chambers 86*a* through 86*f* and send temperature data to the controller 110. Dependent on the supplied temperature data, the controller 110 controls the flow control valves 108 to increase or decrease the amounts of air supplied to the casings 84*a* through 84*f*. The temperature of the air applied to one lateral side of the automotive body 16 can thus be adjusted to a prescribed temperature at all times.

The air supplied into the casings 96*a*, 96*b*, after having cooled the induction coils 102 in the casings 96*a*, 96*b*, is heated to a predetermined temperature and applied to one side area of the upper side of the automotive body 16 to assist in drying the paint coating on the upper side thereof.

The second air blower means 20 is actuated in the same manner as the first air blower means 18 to supply air into the casings 90*a* through 90*f*, 96*c*, 96*d*. After having cooled the induction coils 92, 102, the air is applied to the other lateral side of the automotive body 16 and the other side area of the upper side thereof.

Since the temperatures of air applied to the lateral sides and upper side of the automotive body 16 are adjusted to predetermined temperatures, the entire coated surface of the automotive body 16 can uniformly be dried.

The air applied to the automotive body 16 flows along the coated surfaces of the automotive body 16 in the directions of the arrows, and is then discharged from the air discharge chamber 72 above the automotive body 16 via the air discharge pipe 74.

With this embodiment, the paint coating on the automotive body 16 can efficiently be dried and the apparatus 80 can economically be manufactured.

More specifically, the air supplied into the casings 84*a* through 84*f*, 90*a* through 90*f*, 96*a* through 96*d* by the first and second air blower means 18, 20 cools the induction coils 88, 92, 102 that have been heated to considerable temperatures, and is heated by the induction coils 88, 92, 102 and thereafter applied to the automotive body 16. Therefore, the process of drying or baking the paint coating on the automotive body 16 can quickly be effected. Inasmuch as no special device for producing and applying hot air to the automotive body 16 is required, the apparatus 80 can be manufactured economically or at a low cost. The cost of the apparatus 80 is also lowered because no dedicated cooling means for cooling the induction coils 88, 92, 102 is necessary.

A method of and an apparatus for baking a coating layer according to still another embodiment of the present invention will hereinafter be described.

Figure 8:
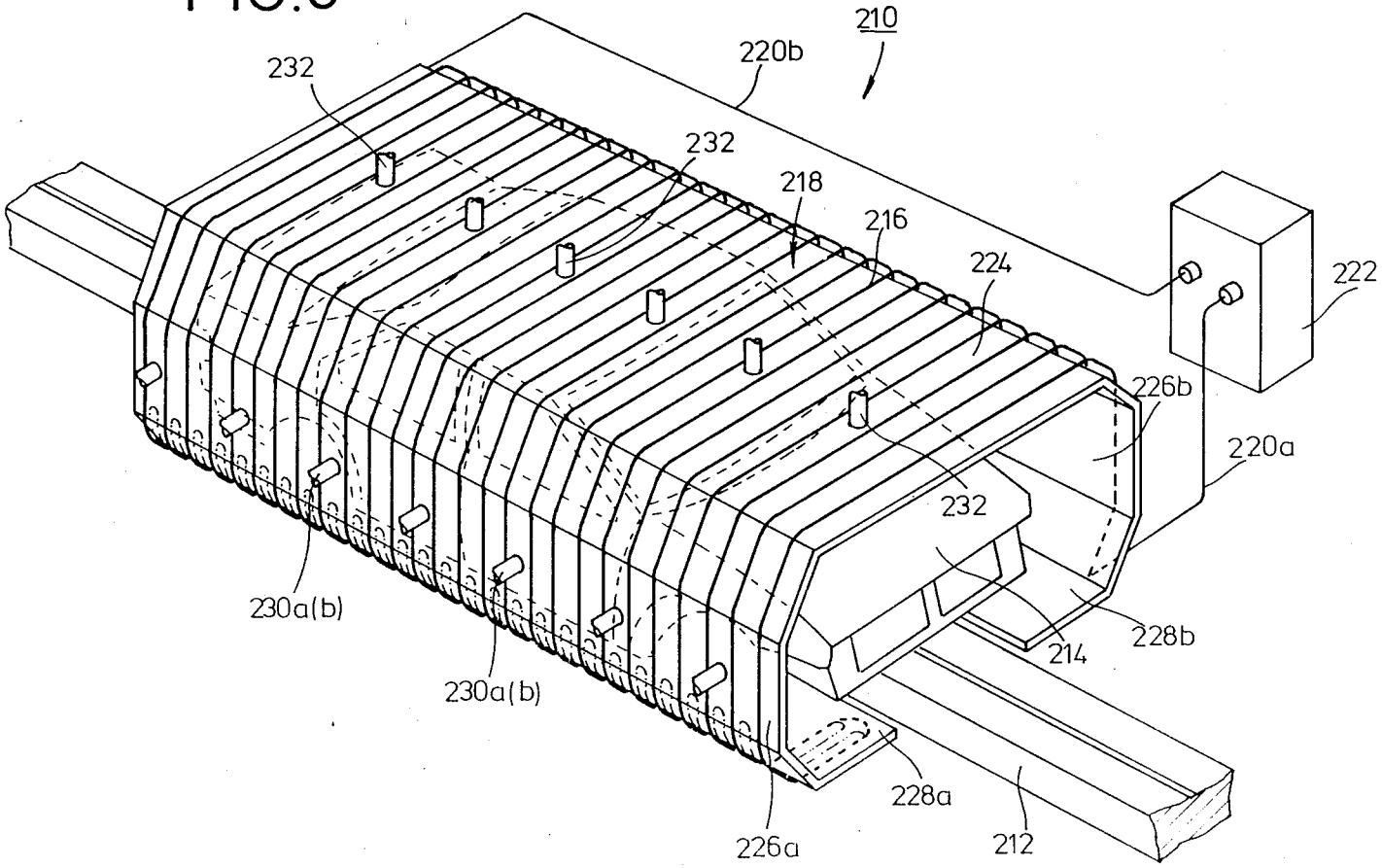
FIG. 8 is a perspective view of an apparatus for carrying out a method of baking a coating layer according to still another embodiment of the present invention.
Figure 9:
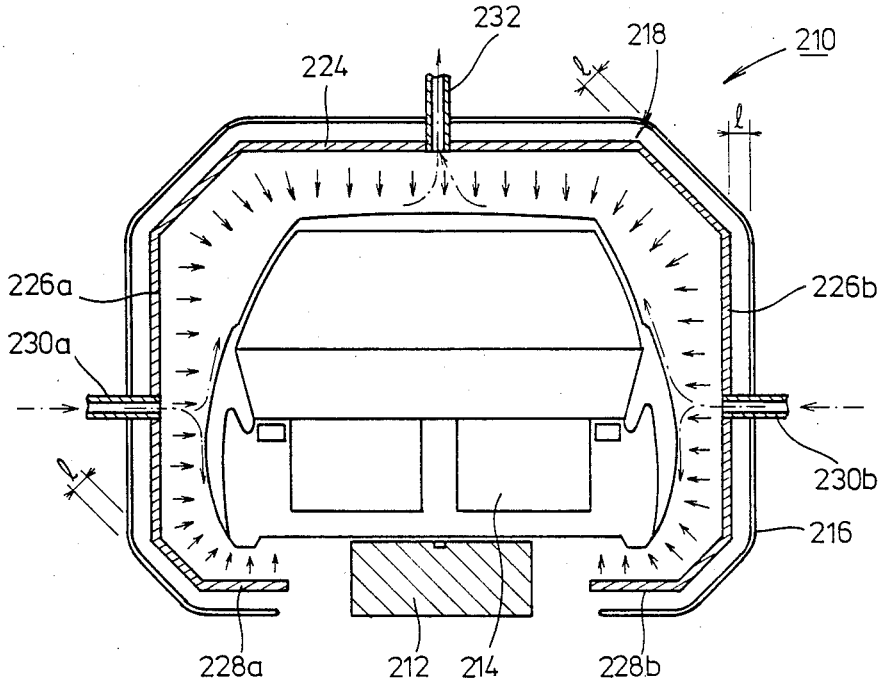
FIG. 9 is a front elevational view explaining operation of the apparatus illustrated in FIG. 8.

FIGS. 8 and 9 illustrate an apparatus 210 for carrying out a method of baking a coating layer in accordance with the still other embodiment of the present invention. The apparatus 210 serves to bake or dry a paint coating or the like applied to an automotive body 214 which has been conveyed by a conveyor means 212.

The apparatus 210 includes an induction coil 216 disposed around the automotive body 214 and a heating housing 218 in the form of a bent plate disposed between the induction coil 216 and the automotive body 214 and defining an inner space accommodating the automotive body 214 therein. The induction coil 216 is bent in surrounding relation to the heating housing 218 and comprises turns including lower ends positioned below opposite lateral sides of the automotive body 214 and spaced certain distances longitudinally of the automotive body 214. The lower ends of the turns of the induction coil 216 may have smaller turns (indicated by the two-dot-and-dash lines in FIG. 8) spaced smaller distances than the distances by which the larger turns of the induction coil 216 are spaced. The opposite ends of the induction coil 216 are electrically connected to ends of leads 220*a*, 220*b* with their opposite ends coupled to an electric power supply 222.

The heating housing 218 is made of an electrically conductive material in the shape of a bent steel plate having a thickness in the range of from 2 mm to 3 mm. The heating housing 218 is of a shape similar to that of the induction coil 216 and includes an upper member 224, lateral side members 226*a*, 226*b*, and lower members 228*a*, 228*b* which are spaced from the corresponding portions of the induction coil 216 by equal distances l (FIG. 9). To the lateral side members 226*a*, 226*b*, there are attached a plurality of spaced pipes 230*a*, 230*b* connected to an air supply source (not shown). A plurality of spaced air discharge ducts 232 are mounted on the upper member 224 of the heating housing 218.

Rather than supplying air from the pipes 230*a*, 230*b* and discharging air from the air discharge ducts 232, air may be introduced into the heating housing 218 from one open end thereof, e.g., its open front end, or air may be applied to the automotive body 214 through the lower open slot of the heating housing 218.

The apparatus 210 shown in FIGS. 8 and 9 operates as follows:

The automotive body 214 to which a paint coating is applied is delivered into the heating housing 218 by the conveyor means 212. The power supply 222 is switched on to supply a high-frequency electric current to the induction coil 216 via the leads 220*a*, 220*b*. The supplied high-frequency current induces eddy currents in the conductive heating housing 218 positioned closely to the induction coil 216, thereby heating the heating housing 218.

When the heating housing 218 is heated by the eddy currents, radiant heat is produced by the heating housing 218 as indicated by the arrows in FIG. 9 to heat air inside the heating housing 218 up to a certain temperature. Therefore, the coated surface of the automotive body 214 surrounded by the heating housing 218 is uniformly heated in its entirety by the heated air to dry or bake the paint coating on the automotive body 214.

The air supply source (not shown) is operated to apply air from the pipes 230*a*, 230*b* to the automotive body 214. The air applied to the automotive body 214 flows upwardly along the coated surface thereof and is then discharged out from the air discharge ducts 232 located above the automotive body 214. The volatilization of the solvent from the coated surface of the automotive body 214 is accelerated by the applied air, so that the solvent is prevented from being trapped in the paint coating and thus a smooth paint coating surface is produced.

According to this embodiment, the entire coated surface of the automotive body 214 is uniformly heated by the simple arrangement to dry or bake the paint coating efficiently and neatly.

More specifically, the heating housing 218 is disposed in surrounding relation to the automotive body 214, and the induction coil 216 is disposed outwardly of the heating housing 218 at a certain spacing. When a high-frequency current is supplied to the induction coil 216, therefore, the conductive heating housing 218 itself is heated by eddy currents induced by the induction coil 216, thereby to heat air inside of the heating housing 218 in its entirety up to a certain temperature with radiant heat from the heating housing 218. Therefore, the entire automotive body 214 surrounded by the heating housing 218 is heated up to a uniform temperature. The automotive body 214 is not subjected to localized temperature differences which would otherwise be caused by the conventional arrangement in which hot air is applied to an automotive body. As a consequence, the paint coating on the automotive body 214 can uniformly be dried, and a sightly paint coat surface of neat and smooth appearance can be produced.

Even if the lower portion of the automotive body 214 has a greater wall thickness than that of the other thinner portions thereof, the entire automotive body 214 can be heated up to a uniform temperature by the apparatus 210. More specifically, the lower ends of the larger turns of the induction coil 216 may have smaller turns spaced a smaller distance than that of the larger turns, as described above. By supplying a high-frequency current to the induction coil 216 from the power supply 222, the lower ends of the lateral side members 226*a*, 226*b* and the lower members 228*a*, 228*b* of the heating housing 218, which are positioned adjacent to the smaller turns of the induction coil 216, are heated to a higher temperature than that of the other members of the heating housing 218. Consequently, the temperature of air near the lower portion of the automotive body 214 becomes higher than that of air around the other portions of the automotive body 214, the net result being that the thicker lower portion and the other portions of the automotive body 214 are heated to the same temperature, making it possible to dry or bake the entire coated surface of the automotive body 214 uniformly.

The temperature to which the automotive body 214 is heated can easily be controlled simply by controlling the magnitude of the high-frequency current supplied to the induction coil 216. The paint coatings on automotive bodies of different kinds can well be dried by the apparatus 210.

While paint coatings on automotive bodies are dried or baked in the aforesaid embodiments, the apparatus of the present invention can also be used to dry other coating layers such as a sealer, an adhesive, or the like applied to a workpiece such as an automotive body.

Figure 10:
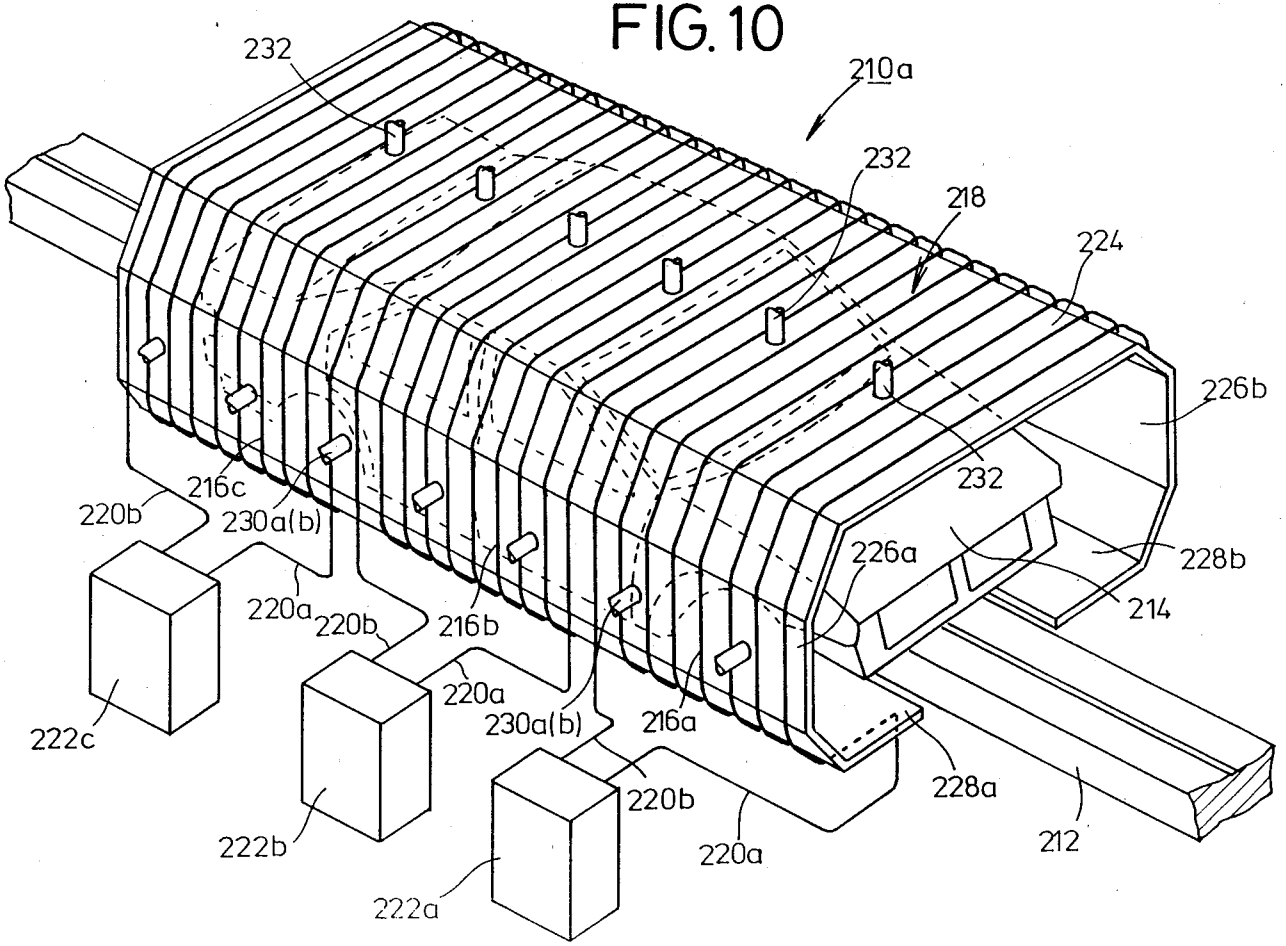
FIG. 10 is a perspective view of an apparatus according to a further embodiment of the present invention.

FIG. 10 shows an apparatus according to a further embodiment of the present invention. Those parts of the apparatus of FIG. 10 which are identical to those of the apparatus 210 shown in FIGS. 8 and 9 are denoted by identical reference characters, and will not be described in detail.

An apparatus 210*a* includes a plurality of induction coils, e.g., three induction coils 216*a*, 216*b*, 216*c* which are electrically connected to respective electric power supplies 222*a*, 222*b*, 222*c* through three pairs of leads 220*a*, 220*b*.

The three induction coils 216*a*, 216*b*, 216*c* are supplied with respective currents from the power supplies 222*a*, 222*b* , 222*c*, respectively. Therefore, a large-size workpiece such as an automotive body 214 can more efficiently be heated by the induction coils. The number of induction coils used may be varied as desired to meet particular applications.

With the present invention, as described above, a coating layer such as a paint coating applied to a workpiece such as an automotive body is dried or baked by heating the workpiece itself. By heating the workpiece, convective flows are produced in the paint coating on the workpiece thereby to smooth the surface of the paint coating. Therefore, no conventional setting step which would otherwise be needed to smooth the paint coating is required, and hence the paint coating on the workpiece can be dried or baked in a short period of time. As the painting line has no setting room, the space taken up by the painting line is reduced, and the painting line can be manufactured economically.

Moreover, a plurality of induction coils displaceable complementarily to the shape of a workpiece are moved toward the workpiece, and electric currents are supplied to the induction coils to heat the workpiece for thereby drying or baking a coating layer such as a paint layer on the workpiece progressively from the surface of the paint coating which is in contact with the workpiece. The temperature to which the workpiece is heated is controlled by adjusting the magnitude of the currents supplied to the induction coils. Therefore, the paint coating applied to the workpiece can efficiently be dried or baked within a short period of time. Since the paint coat layer is dried progressively from its surface contacting the workpiece, no solvent is trapped in the paint coating, and a resultant paint coating surface is smooth and free of pinholes and other defects.

At the same time that the workpiece is heated by supplying electric currents to the induction coils, air is applied to the coated surface of the workpiece to prevent a volatilized solvent from being trapped in the paint coating. Consequently, the volatilization of the solvent is promoted, and the paint coating is made smoother.

When the induction coils displaced toward the workpiece are supplied with currents to heat the workpiece, a gas such as air is introduced from outside the induction coils toward the workpiece to cool the induction coils, and thereafter the gas heated by the induction coils is applied to the coated surface of the workpiece. Therefore, no special heating source for applying hot air to the workpiece, and no dedicated means for cooling the induction coils are required, so that the apparatus for baking the coating layer can be manufactured at a low cost.

The temperatures of the gas heated by the induction coils are detected, and the amounts of the gas to be supplied are controlled on the basis of the detected temperatures. As a consequence, the gas kept at a desired temperature can be applied to the workpiece at all times to assist in drying or baking the coated surface uniformly.

According to the present invention, furthermore, a workpiece is surrounded by a heating housing made of an electrically conductive material, and an induction coil disposed around the heating housing is supplied with a high-frequency electric current to heat the heating housing which then gives off radiant heat to heat the workpiece. By thus heating the heating housing surrounding the workpiece, the workpiece can uniformly be heated in its entirety by the radiant heat from the heating housing. Thus, a coating layer such as a paint coating applied to the workpiece can be dried or baked in its entirety under uniform conditions to produce a sightly coating surface of good appearance. A solvent volatilized from the paint coating can be prevented from being trapped in the paint coating by applying a gas such as air to the workpiece while the paint coating is being dried.

Where a workpiece has different wall thicknesses, turns of the induction coil adjacent to a portion of the workpiece which has a larger wall thickness are spaced a smaller distance than that of the other turns of the induction coil. The workpiece is thus subjected to higher induction heating where the turns are arranged more closely, so that the temperature of air near the thicker portion of the workpiece becomes higher than the temperature of air around the other portions of the workpiece. As a result, the paint coating on a workpiece having different wall thicknesses can effectively be dried or baked. The coating layers on workpieces of different shapes can efficiently be dried by the apparatus of the invention. Therefore, the apparatus according to the present invention is highly versatile or can meet different applications.

Although certain preferred embodiments have been shown and described, it should be understood that many changes and modifications may be made therein without departing from the scope of the appended claims.

What is claimed is:

1. A method of baking a coating layer on an electrically conductive workpiece, comprising the steps of:
- holding an induction coil closely to said workpiece;
- supplying an electric current to said induction coil to induce eddy currents in said workpiece to heat the workpiece with said eddy current;
- applying a gas to the surface of said coating layer to dry the same;
- detecting the temperature of said gas near said induction coil; and
- adjusting the amount of gas to be introduced toward said workpiece dependent on the detected temperature for thereby applying the gas heated to a desired temperature to the surface of said coating layer.

2. A method according to claim 1, wherein in said gas applied to the surface of said coating layer flows as laminar flows.

3. A method according to claim 1 or 2, wherein the magnitude of the electric current supplied to said induction coil is controlled to adjust the temperature to which said workpiece is heated.

4. An apparatus for baking a coating layer on an electrically conductive workpiece, comprising:
- a plurality of coating drying mechanisms disposed to surround the workpiece;
- a gas supply source;
- each of said coating drying mechanisms including a plurality of induction coils displaceable complementarily to the shape of the workpiece to a position spaced a predetermined distance from the workpiece;
- displacing means for displacing said induction coils;
- applying means for applying a gas supplied from said gas supply source to the coating layer on said workpiece;
- detecting means for detecting the temperature of said gas near said induction coil; and
- means for adjusting the amount of gas to be introduced toward said workpiece dependent on the detected temperature for thereby applying the gas heated to a desired temperature to the surface of said coating layer.

5. An apparatus according to claim 4, wherein said displacing means comprises a linear actuator movable toward and away from said workpiece.

6. An apparatus according to claim 4 or 5, wherein said applying means comprises an air blower chamber coupled to said gas supply source and a tube communicating with said air blower chamber and expandable toward and contractable away from the coating layer on said workpiece.

7. An apparatus according to claim 4, wherein each of said coating drying mechanisms has a discharge port for discharging the gas applied to the coating layer on the workpiece.

8. A method of baking a coating layer, comprising the steps of: applying a coating layer to an electrically conductive workpiece; holding an induction coil closely to said workpiece; supplying an electric current to said induction coil to induce eddy currents in said workpiece to heat the workpiece with said eddy current; introducing a gas from outside of said induction coil toward said workpiece to cool said induction coil with said gas; and applying the gas heated by said induction coil to the surface of the coating layer to dry the same.

9. A method according to claim 8 wherein the temperature of the gas near said induction coil is detected, and then the amount of the gas to be introduced toward said workpiece is adjusted dependent on the detected temperature for thereby applying the gas heated to a desired temperature to the surface of said coating layer.

10. An apparatus for baking a coating layer on an electrically conductive workpiece, comprising: a plurality of coating drying mechanisms disposed to surround the workpiece; and blower means, each of said coating drying mechanisms comprising a plurality of casings having one end open toward the workpiece and movable, toward and away from the workpiece, and induction coils disposed respectively in said casings, the arrangement being such that a gas supplied from said blower means is applied through said induction coils in said casings to the surface of said coating layer.

11. An apparatus according to claim 10, wherein said induction coils are disposed in said casings near said open ends, said blower means having outlet ports opening at opposite ends of said casings for applying the gas through gaps of said induction coils to the surface of said coating layer.

12. An apparatus according to claim 10 or 11, further including drive sources coupled respectively to said casings for moving the casings toward and away from said workpiece, said blower means including tubes in the form of bellows connected to said casings.

13. An apparatus according to claim 10 or 11, wherein said blower means has a gas supply source, further including a flow control valve disposed between said gas supply source and said casings, and a temperature sensor disposed in one of said casings near the induction coil, and means for adjusting the amount of the gas to be supplied to said casings based on the temperature detected by said temperature sensor.

14. A method of baking a coating layer on a workpiece, wherein said workpiece has a first portion of a greater thickness and a second portion of a smaller thickness, comprising the steps of: applying a coating layer to said workpiece; thereafter bringing said workpiece into an electrically conductive heating housing; supplying an electric current to an induction coil disposed outside said heating housing to induce eddy currents in said workpiece to heat the workpiece with said eddy currents, wherein said induction coil includes a first group of turns adjacent to said first portion and a second group of turns adjacent to said second portion, said turns of the first group being spaced a smaller distance than the distance by which said turns of the second group are spaced; and heating said workpiece with radiant heat produced from said heating housing to dry the coating layer on the workpiece.

15. A method according to claim 14, wherein a gas is applied to the surface of the coating layer on the workpiece while said workpiece is being heated by the heating housing which is heated by said induction coil.

16. An apparatus for baking a coating layer on a workpiece, wherein the workpiece has a first portion of a greater thickness and a second portion of a smaller thickness, comprising: an electrically conductive heating housing defining a space for receiving the workpiece therein; an induction coil disposed outside said heating housing, said heating housing and said induction coil being spaced from each other; and an electric power supply coupled to said induction coil for energizing the induction coil to heat said heating housing by induction to cause the heating housing to produce heat for drying the coating layer on the workpiece; wherein said induction coil includes a first group of turns adjacent to said first portion and a second group of turns adjacent to said second portion, said turns of the first group being spaced a smaller distance than the distance by which said turns of the second group are spaced.

17. An apparatus according to claim 16, wherein said heating housing and said induction coil are spaced from each other by a substantially equal distance at any position therebetween.

18. An apparatus according to claim 16, further including gas supply means for applying a gas to the surface of the coating layer on the workpiece when the workpiece is heated.

19. An apparatus according to claim 16, wherein said induction coil comprises a plurality of induction coils, and said electric power supply comprises a plurality of electric power supplies connected respectively to said induction coils.

* * * * *